United States Patent [19]

Degner et al.

[11] Patent Number: 4,539,081

[45] Date of Patent: Sep. 3, 1985

[54] PREPARATION OF BENZALDEHYDE DIALKYL ACETALS

[75] Inventors: Dieter Degner, Dannstadt-Schauernheim; Heinz Hannebaum, Ludwigshafen; Hardo Siegel, Speyer; Walter Gramlich, Edingen-Neckarhausen, all of Fed. Rep. of Germany

[73] Assignee: BASF Aktiengesellschaft, Fed. Rep. of Germany

[21] Appl. No.: 623,210

[22] Filed: Jun. 21, 1984

[30] Foreign Application Priority Data

Jun. 22, 1983 [DE] Fed. Rep. of Germany ..... 3322399

[51] Int. Cl.[3] ..... C25B 3/02

[52] U.S. Cl. ..... 204/78

[58] Field of Search ..... 204/78

[56] References Cited

FOREIGN PATENT DOCUMENTS 0012240 11/1979 European Pat. Off. .
0030588 9/1980 European Pat. Off. .
2948455 12/1979 Fed. Rep. of Germany .
2351932 5/1976 France .

OTHER PUBLICATIONS

A. Nilsson et al., Anodic Functionalisation in Synthesis, Part 1, J.C.S. Perkin, 1978, pp. 708–715.

*Primary Examiner*—R. L. Andrews
*Attorney, Agent, or Firm*—Keil & Weinkauf

[57] ABSTRACT

Benzaldehyde dialkyl acetals of the formula

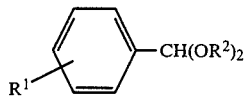

I wherein $R^1$ and $R^2$ are each alkyl, are prepared by electrochemical oxidation of an alkyltoluene of the formula

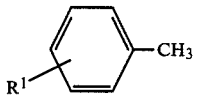

II by a process in which the electrolyte used contains from 60 to 90% by weight of an alkanol of the formula $R^2OH$, from 8.5 to 40% by weight of the alkyltoluene and from 0.01 to 1.5% by weight of an $HO_3S$-containing acid.

6 Claims, No Drawings

PREPARATION OF BENZALDEHYDE DIALKYL ACETALS

The present invention relates to a novel process for the preparation of alkyl-substituted benzaldehyde dialkyl acetals by electrochemical oxidation of an alkyltoluene.

J. Chem. Soc. Perkin I. 1978, 708 discloses that p-methoxytoluene and p-xylene can be converted to anisaldehyde dimethyl acetal and 4-methylbenzaldehyde dimethyl acetal respectively, by anodic oxidation. In this electrochemical oxidation, which is carried out in methanol and in the presence of sodium methylate or lutidine, the yields are only from 57 to 66%. Furthermore, the working up of the basic electrolyte is an involved procedure. European Pat. No. 12,240 describes a process for the preparation of benzaldehyde dialkyl acetals, in which the electrochemical oxidation of the toluenes is carried out in alcoholic solution and in the presence of tetraalkyl ammonium sulfonates and phosphates as conductive salts. To prevent the pH from falling below 7, for example collidine is added to the electrolyte, as an auxiliary base. In the electrochemical oxidation of p-xylene and 4-tert.-butyltoluene, this method gives yields of only 64 and 55%. Better yields are obtained only when the low-boiling by-products are first hydrogenated over a Pd catalyst and then recycled to the electrolysis. If the electrochemical oxidation is carried out by the process described in German Pat. No. 2,848,397, these disadvantages are avoided by virtue of the fact that potassium fluoride is used as a conductive salt, but the electrochemical oxidation of p-xylene gives poorer yields than that of p-methoxytoluene.

European Pat. No. 30,588 and German Laid-Open Application DOS 2,948,455 disclose that the electrochemical oxidation of 4-tert.-butyltoluene to 4-tert.-butylbenzaldehyde can be carried out in emulsions which contain acids possessing $HO_3S$ groups. However, these processes give satisfactory yields only for low conversions of 4-tert.-butyltoluene. The synthesis requires a technically complicated partitioned cell. Moreover, the lead dioxide anodes used are unstable in long-term experiments, so that it has not been possible to realize these processes on an industrial scale.

French Pat. No. 2,351,932 describes a process in which toluenes are oxidized anodically at Pt electrodes. This process gives very poor yields (12–20%) of product mixtures consisting of benzaldehyde and anisaldehyde, and employs electrolytes consisting of toluene, an inert organic solvent, such as methylene chloride, methanol and an $HO_3S$-containing acid. In the electrochemical oxidation of p-xylene (cf. Example 11), this process gives a mixture which contains ether and ester compounds and 4-methylbenzaldehyde but does not contain any 4-methylbenzaldehyde dimethyl acetal.

We have found that benzaldehyde dialkyl acetals of the general formula

I

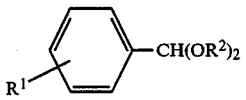

wherein $R^1$ is alkyl of 1 to 8 carbon atoms and $R^2$ is methyl or ethyl, can be prepared particularly advantageously by electrochemical oxidation of an alkyltoluene of the general formula

II

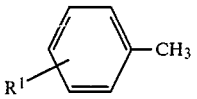

in an alkanol of the formula $R^2OH$ and in the presence of an $HO_3S$-containing acid, if the electrochemical oxidation is carried out using an electrolyte which contains from 60 to 90% by weight of the alkanol, from 8.5 to 40% by weight of the alkyltoluene and from 0.01 to 1.5% by weight of the acid.

Surprisingly, the process according to the invention gives the benzaldehyde dialkyl acetals in good yields and in a particularly economical manner, while avoiding the disadvantages described.

Examples of alkyl radicals of 1 to 8 carbon atoms are methyl, ethyl, isopropyl and n-, iso- and tert.-butyl. Preferred alkyltoluenes are xylenes and butyltoluenes, e.g. p-xylene and 4-tert.-butyltoluene. Of the two alkanols, methanol is particularly important industrially. Examples of $HO_3S$-containing acids are those of the formula $R^3$—$SO_3H$, where $R^3$ is alkyl, aryl, hydroxyl or alkoxy. Preferred acids are methanesulfonic acid, benzenesulfonic acid, methylsulfuric acid and in particular sulfuric acid.

The novel process does not require special electrolysis cells and is preferably carried out in unpartitioned electrolysis cells. Preferred electrolytes are those which contain from 70 to 90% by weight of the alkanol, from 8.5 to 30% by weight of the alkyltoluene and from 0.05 to 1.5% by weight of the acid.

Suitable anodes are all conventional anodes which are stable under the electrolysis conditions, graphite anodes preferably being used. Examples of suitable cathode materials are steel, nickel, noble metals or graphite. The current density during electrolysis is, for example, from 2 to 20, preferably from 2 to 12, $A/dm^2$. The electrolysis temperature is restricted by the boiling point of the alkanol. Where methanol is used, the electrolysis is carried out at, for example, at up to 60° C., preferably from 20° to 60° C. Surprisingly, we have found that the novel process provides the possibility of effecting substantial conversion of the alkyltoluenes, and of the alkylbenzyl alkyl ethers formed as intermediates, without having a substantial adverse effect on the selectivity of the electrochemical oxidation. For example, the electrolysis is carried out using from 2.8 to 7 F, preferably from 4 to 6.5 F, per mole of alkyltoluene. The process can be carried out either batchwise or continuously.

The mixture obtained after electrolysis can be worked up in a very simple manner. For example, the small amount of acid is neutralized with an equivalent amount of an alkali, sodium hydroxide or sodium methylate being added when, for example, sulfuric acid is used. The alkanol and any alkyltoluene and alkylbenzyl alkyl ether still present are then distilled off and, if desired, recycled to the electrolysis. the alkylbenzaldehyde dialkyl acetal can then be purified further by distillation under reduced pressure.

In carrying out the novel process, we have found that the electrochemical oxidation can be carried out for a relatively long time without problems with the electrodes being encountered or the selectivity of the electrochemical oxidation being adversely affected. This is surprising since the electrodes have a very undesirable tendency to form a deposit, particularly when the electrolyte is simultaneously recycled, and this behavior frequently prevents an organic electrolysis from being carried out industrially.

The benzaldehyde dialkyl acetals obtainable by the novel process are useful intermediates for scents and fungicides.

EXAMPLE 1

| | |
|---|---|
| Electrolysis cell: | unpartitioned cell with 9 graphite electrodes (area per anode: 1.7 $dm^2$) |
| Electrode spacing: | 0.5 mm |
| Electrolyte: | 425 g of p-xylene (15.1% by weight)<br>2,370 g of methanol (84.4% by weight)<br>14 g of $H_2SO_4$ (0.5% by weight) |
| Current density: | 3.3 $A/dm^2$ |
| Cell voltage: | 56–69 V |
| Temperature: | 20–30° C. |
| Electrolysis with 5.3 F/mole of p-xylene. | |

During the electrolysis, the electrolyte is pumped through a heat exchanger at a rate of 200 liters/hour.

Working up:

The electrolyte is neutralized with sodium methylate, methanol is distilled off under atmospheric pressure, the precipitated salt is filtered off and the crude acetal is purified by distillation at 50°–120° C. under 15–20 mbar. 76.4 g of p-xylene, 69.1 g of 4-methylbenzyl ether and 366.6 g of 4-methylbenzaldehyde dimethyl acetal are obtained. This corresponds to a yield of 79.4%, based on p-xylene employed.

EXAMPLE 2

| | |
|---|---|
| Electrolysis cell: | unpartitioned cell with 11 graphite electrodes (area per anode: 1.7 $dm^2$) |
| Electrode spacing: | 0.5 mm |
| Electrolyte: | 425 g of p-xylene (15.1% by weight)<br>2,370 g of methanol (84.4% by weight)<br>14 g of $CH_3SO_3H$ (0.5% by weight) |
| Current density: | 3.3 $A/dm^2$ |
| Cell voltage: | 45–61 V |
| Temperature: | 20–30° C. |
| Electrolysis with 6.3 F/mole of p-xylene. | |

The electrolysis and the working-up procedure are carried out as stated in Example 1. 51.6 g of p-xylene, 34.4 g of 4-methylbenzyl ether and 366.9 g of 4-methylbenzaldehyde dimethyl acetal are obtained. This corresponds to a yield of 67.6%.

EXAMPLE 3

| | |
|---|---|
| Electrolysis cell: | unpartitioned cell with 11 graphite electrodes (area per anode: 1.7 $dm^2$) |
| Electrode spacing: | 0.5 mm |
| Electrolyte: | 425 g of p-xylene (15% by weight)<br>2,370 g of methanol (84% by weight)<br>28 g of $C_6H_5SO_3H$ (1% by weight) |
| Current density: | 3.3 $A/dm^2$ |
| Cell voltage: | 55–62 V |
| Temperature: | 20–30° C. |
| Electrolysis with 4.7 F/mole of p-xylene. | |

The electrolysis and the working up procedure are carried out as described in Example 1. 95.6 g of p-xylene, 112.2 g of p-methylbenzyl methyl ether and 293.3 g of p-methylbenzaldehyde dimethyl acetal are obtained. This corresponds to a yield of 77.4%.

EXAMPLE 4

| | |
|---|---|
| Electrolysis cell: | unpartitioned cell with 8 graphite electrodes (area per anode: 1.7 $dm^2$) |
| Electrode spacing: | 1 mm |
| Electrolyte: | 540 g of 4-tert.-butyltoluene (15% by weight)<br>3,051 g of methanol (84.75% by weight)<br>9 g of $H_2SO_4$ (0.25% by weight) |
| Current density: | 4.4 $A/dm^2$ |
| Cell voltage: | 54–58 V |
| Temperature: | 25–38° C. |
| Electrolysis with 6.1 F/mole of 4-tert.-butyltoluene. | |

During the electrolysis, the electrolyte is pumped through a heat exchanger at a rate of 200 liters/hour.

Working up:

The mixture obtained after the electrolysis is neutralized with sodium methylate, methanol is distilled off under atmospheric pressure and the precipitated salt is separated off via a pressure filter. The filtrate is purified by distillation at 70°–120° C. under 1–5 mbar. 17.1 g of 4-tert.-butyltoluene, 89.9 g of 4-tert.-butylbenzyl methyl ether (which can be recycled to the electrolysis) and 461.6 g of 4-tert.-butylbenzaldehyde dimethyl acetal are obtained. This corresponds to a yield of 73.3%, based on p-tert.-butyltoluene employed.

EXAMPLE 5

| | |
|---|---|
| Electrolysis cell: | unpartitioned cell with 6 graphite electrodes (area per anode: 1.7 $dm^2$) |
| Electrode spacing: | 1 mm |
| Electrolyte: | as in Example 4 |
| Current density: | 5.9 $A/dm^2$ |
| Cell voltage: | 38 V |
| Temperature: | 35–40° C. |
| Electrolysis with 6.1 F/mole of 4-tert.-butyltoluene. | |

The electrolysis and the working-up procedure are carried out as stated in Example 4. 10.7 g of 4-tert.-butyltoluene, 37.2 g of 4-tert.butylbenzyl methyl ether and 483.4 g of 4-tert.-butylbenzaldehyde dimethyl acetal are obtained. This corresponds to a yield of 69%.

EXAMPLE 6

The electrolysis cell, the electrode spacing and the electrolyte are as stated in Example 5.

| | |
|---|---|
| Current density: | 10 $A/dm^2$ |
| Cell voltage: | 49–56 V |
| Temperature: | 45° C. |

-continued

| |
|---|
| Electrolysis with 6 F/mole of 4-tert.-butyltoluene. |

The electrolysis and the working-up procedure are carried out as described in Example 4. 12.9 g of 4-tert.-butyltoluene, 70.2 g of 4-tert.-butylbenzyl methyl ether and 470 g of 4-tert.-butylbenzaldehyde dimethyl acetal are obtained. This corresponds to a yield of 71.4%.

EXAMPLE 7

| | |
|---|---|
| Electrolysis cell: | unpartitioned cell with 11 graphite electrodes (area per anode: 1.7 $dm^2$) |
| Electrode spacing: | 0.5 mm |
| Electrolyte: | As in Example 4 |
| Current density: | 2.94 $A/dm^2$ |
| Cell voltage: | 53–54 V |
| Temperature: | 24–35° C. |
| Electrolysis with 5 F/mole of 4-tert.-butyltoluene. | |

The electrolysis and the working-up procedure are carried out as described in Example 4. 55.9 g of 4-tert.-butyltoluene, 179.1 g of 4-tert.-butylbenzyl methyl ether and 303.5 g of 4-tert.-butylbenzaldehyde dimethyl acetal are obtained. This corresponds to a yield of 64.4%.

EXAMPLE 8

| | |
|---|---|
| Electrolysis cell: | unpartitioned cell with 11 graphite electrodes (area per anode: 1.7 $dm^2$) |
| Electrode spacing: | 0.5 mm |
| Electrolyte: | 419 g of 4-tert.-butylbenzyl methyl ether (15% by weight)<br>7 g of $H_2SO_4$ (0.25% by weight)<br>2,370 g of methanol (84.75% by weight) |
| Current density: | 2.94 $A/dm^2$ |
| Cell voltage: | 40–44 V |
| Temperature: | 22–27° C. |
| Electrolysis with 3 F/mole of 4-tert.-butylbenzyl methyl ether. | |

The electrolysis and the working-up procedure are carried out as described in Example 4. 11.8 g of 4-tert.-butylbenzyl methyl ether and 353.6 g of 4-tert.-butylbenzaldehyde dimethyl acetal are obtained. This corresponds to a yield of 74.3%.

We claim:

1. A process for the preparation of a benzaldehyde dialkyl acetal of the formula

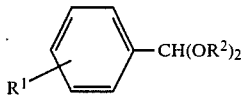

I where $R^1$ is alkyl of 1 to 8 carbon atoms and $R^2$ is methyl or ethyl, by electrochemical oxidation of an alkyltoluene of the formula

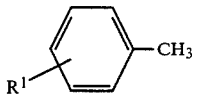

II in an alkanol of the formula $R^2OH$ and in the presence of an $HO_3S$-containing acid, wherein the electrochemical oxidation is carried out using an electrolyte which contains from 60 to 90% by weight of the alkanol, from 8.5 to 40% by weight of the alkyltoluene and from 0.01 to 1.5% by weight of the acid.

2. A process as claimed in claim 1, wherein the electrolyte used contains from 70 to 90% by weight of the alkanol, from 8.5 to 30% by weight of the alkyltoluene and from 0.05 to 1.5% by weight of the acid.

3. A process as claimed in claim 1, wherein the electrolysis is carried out at graphite anodes in an unpartitioned cell.

4. A process as claimed in claim 1, wherein the electrolyte contains, as the acid, benzenesulfonic acid, methanesulfonic acid, methylsulfuric acid or sulfuric acid.

5. A process as claimed in claim 1, wherein the alkyltoluene used is p-xylene or 4-tert.-butyltoluene.

6. A process as claimed in claim 1, wherein the alkanol used is methanol.

* * * * *